United States Patent [19]

Chen

[11] Patent Number: 5,067,196

[45] Date of Patent: Nov. 26, 1991

[54] MUD ABSORBENT MAT

[76] Inventor: Lung-Hsien Chen, 940, Chung Cheng Rd., Yung Kang Hsiang, Tainan Hsien, Taiwan

[21] Appl. No.: 612,986

[22] Filed: Nov. 15, 1990

[51] Int. Cl.[5] ..... A47L 23/22

[52] U.S. Cl. ..... 15/238; 15/231; 15/244.1

[58] Field of Search ..... 15/238, 215, 216, 217, 15/237, 244.1, 231

[56] References Cited

U.S. PATENT DOCUMENTS

| | | | |
|---|---|---|---|
| 2,604,377 | 7/1952 | Eames | 15/238 X |
| 2,794,201 | 6/1957 | Kutik | 15/231 X |
| 3,140,644 | 7/1964 | Lee | 15/238 X |
| 4,377,016 | 3/1983 | Niermeijer | 15/238 X |

FOREIGN PATENT DOCUMENTS

| | | | |
|---|---|---|---|
| 283308 | 1/1928 | United Kingdom | 15/238 |

*Primary Examiner*—Chris K. Moore

*Attorney, Agent, or Firm*—Morton J. Rosenberg; David I. Klein

[57] ABSTRACT

An improved absorbent mud mat which includes a plate member having holes passing therethrough. The absorbent mud mat includes a plurality of scrapers, a sponge member and a base having a rail passing around a top inner edge. In assembly, the scrapers of the plate member act as a scraper for sturdy shoes to scrape dirt from the shoes and the sponge acts as a water collector to absorb water from the shoe. In this manner, the dirt and water removed from a user's shoes may be captured and contained in a confined space.

1 Claim, 3 Drawing Sheets

MUD ABSORBENT MAT

BACKGROUND OF THE INVENTION

This invention is directed to an improved absorbent mat used both domestically and commercially. In particular the absorbent mat of the subject invention concept may be used in homes, offices, vehicles and factories. The subject absorbent mud mat is further directed to a system which efficiently provides for the scraping of mud from a user's shoe. Still further, the subject absorbent mat provides for collection mud scraped from shoes while simultaneously absorbing and containing water from the user's shoes.

SUMMARY OF THE INVENTION

It is a primary object of the present invention to provide an absorbent mud mat which includes an improved mud scraper to remove dirt from shoes.

It is another object of the present invention to provide an absorbent mud mat which collects and absorbs dirty water shed from a user's shoe.

It is still another object of the present invention to provide an absorbent mud mat which will capture and contain the dirt removed from shoes.

It is a further object of the present invention to provide an absorbent mud mat which which obviate dirty water on the carpet of a vehicle.

It is still a further object of the present invention to provide an absorbent mud mat which is inexpensive to produce.

There is provided an absorbent mud mat which includes a plate having a plurality of holes and scrapers. The absorbent mud mat has a frame about the periphery thereof and the scrapers have inclined upper surfaces with each of the scrapers having a lower section forming a plug member. An integrally formed base is provided having a plurality of blind holes. Each of the blind holes being in alignment with and larger than a corresponding one of the plug members. The base includes a peripheral rail at a top inner edge. A sponge mat is provided corresponding in extent with the plate and having a pattern of holes coinciding with the holes of the base. The frame of the plate engages the rail of the base with the plug members of the scrapers passing through the holes in the sponge and being inserted into the blind holes of the base.

DESCRIPTION OF THE PREFERRED EMBODIMENTS

Figure 1:
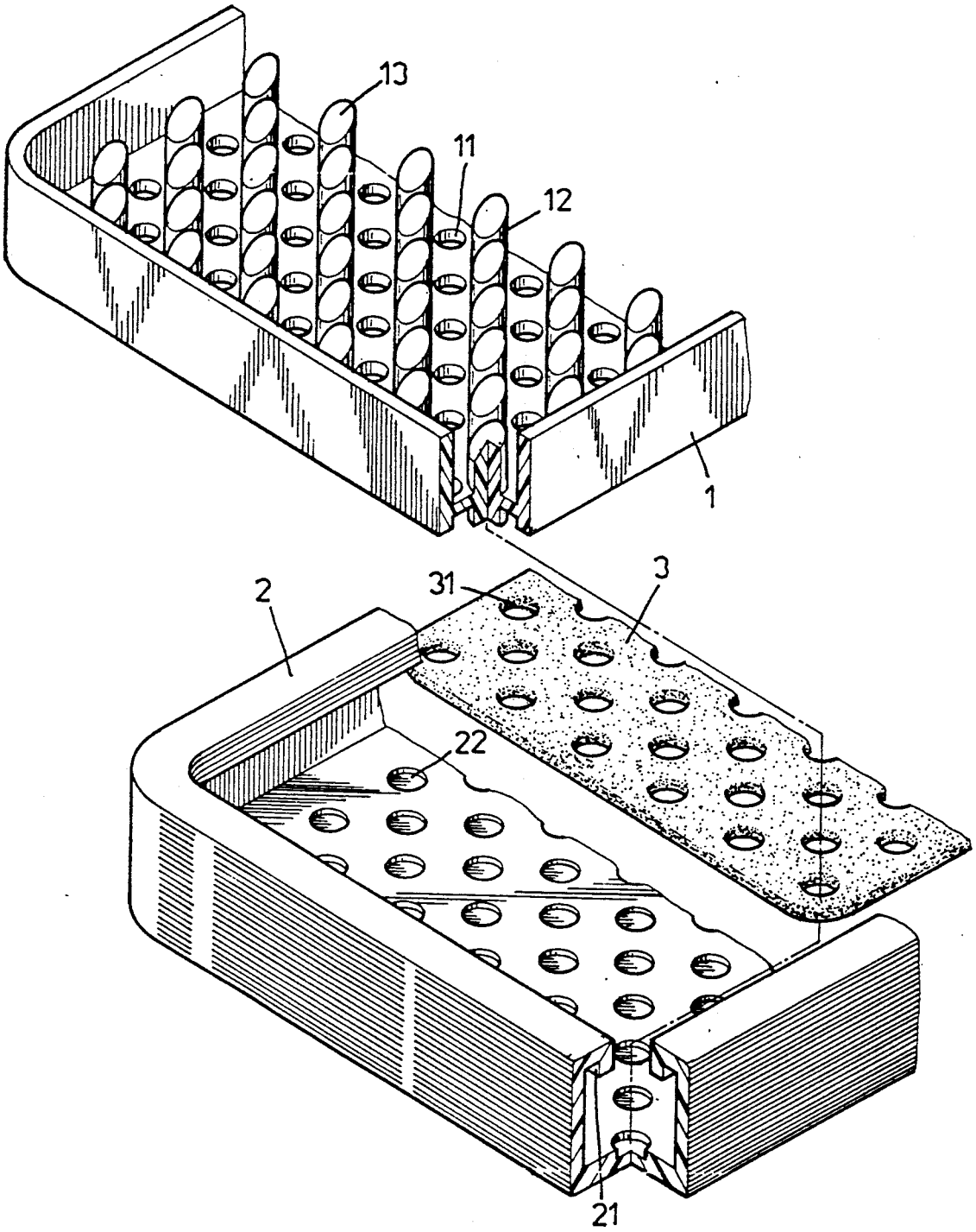
FIG. 1 is a perspective, partially cut-away view of the subject absorbent mud mat.
Figure 2:
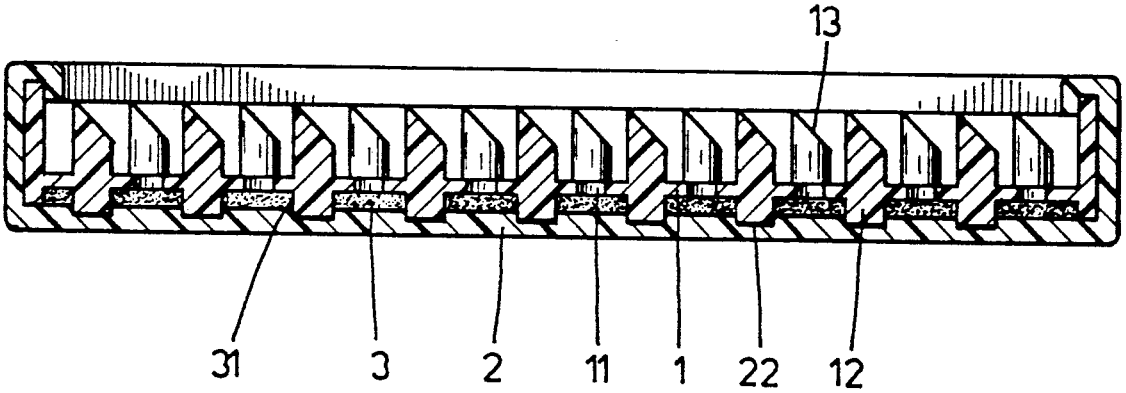
FIG. 2 is a cross-sectional view of the present invention concept.
Figure 3:
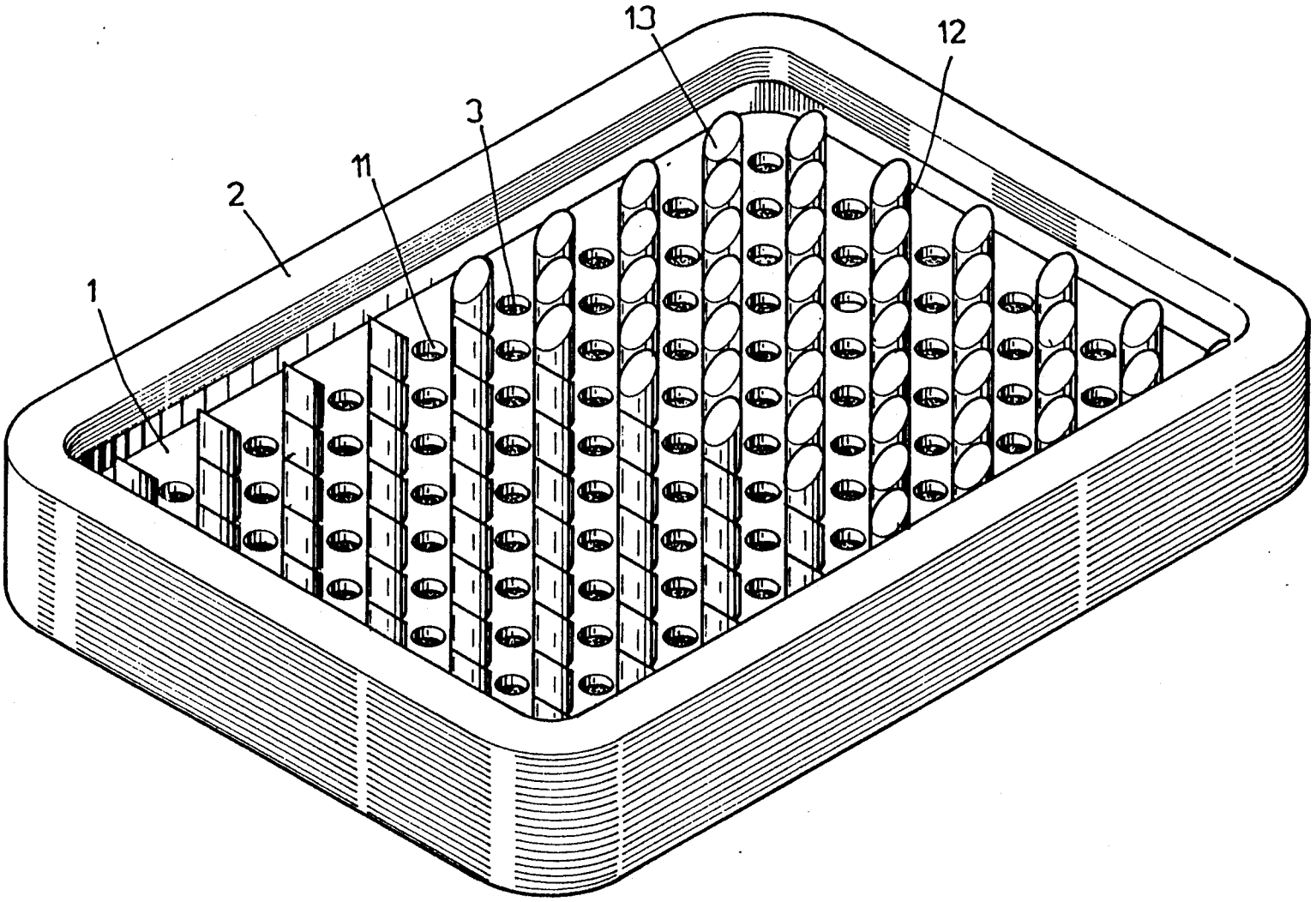
FIG. 3 is a perspective view of the absorbent mud mat of the subject invention.

Referring now to FIGS. 1-3, there is shown an absorbent mud mat which includes plate 1 having a number of holes 11, a plurality of scrapers 12 having inclined end surfaces 3 are formed at an upper end of each scraper 12. The absorbent mud mat further includes frame 14 peripherally surrounding plate 1.

Each scraper 12 includes lower plug member 15 extending below plate 1. Base 2 includes rail 21 formed around a top inner edge and a plurality of blind holes 22 as shown in FIG. 2.

Sponge 3 having a plurality of through openings or holes 31 is mounted within base 2 and in contiguous contact with a lower surface thereof. Each of openings or holes 31, sponge 3 and blind holes 22 are aligned with respective plug members 15 of plate 1.

The assembled absorbent mud mat is shown in FIG. 3. In order to assemble the absorbent mud mat, initially locate sponge 3 on top of base 2 with each of through openings 31 in alignment with respective blind holes 22 formed in the bottom portion of base 2. The top edge of rail 21 of base 2 formed of a flexible plastic is deformed outwardly and plate 1 is mounted on base 2. Frame 14 of plate 1 is inserted under rail 21 of base 2 and captured thereby. Plug members 15 of the plate 1 are inserted through the through openings 31 of sponge 3 into blind holes 22 of base 2 as shown in FIG. 2.

This arrangement of absorbent mud mat elements allows mud and dirty water to be removed from shoes and directs the flow to the bottom of base 2. Due to the fact that base 2 is integrally formed, there are no gaps, thus, neither mud nor dirty water egresses from the absorbent mud mat and maintains collected water and mud within base 2 to provide a clean external environment.

Scrapers 12 are formed of a hardened material with inclined surfaces 13 and the sponge 3 respectively scrapes mud and absorbs dirty water from a user's shoe in an optimized cleaning manner.

It is claimed:

1. An absorbent mud mat comprising:

a plate member having a plurality of holes and scraper members, said plate member having a frame formed about the periphery thereof, said scraper members having inclined upper surfaces, each of said scraper members having a lower section forming a plug member;

an integrally formed base having a plurality of blind holes, each of said blind holes in alignment with and larger than a corresponding one of said plug members, said base having a peripheral rail formed at a top inner edge;

a sponge corresponding in dimensional extent with said plate and having a pattern of holes coinciding with said holes of said base, said frame of said plate member engaging the rail of said base with said plug members of said scrapers passing through said holes in said sponge and being inserted into the blind holes of said base.

* * * * *